US009882289B2

(12) United States Patent
Seipel et al.

(10) Patent No.: US 9,882,289 B2
(45) Date of Patent: Jan. 30, 2018

(54) SHEET METAL PART WITH IMPROVED CONNECTION TAB GEOMETRY

(71) Applicants: TE Connectivity Germany GmbH, Bensheim (DE); TE Connectivity India Private Limited, Bangalore (IN)

(72) Inventors: Volker Seipel, Bensheim (DE); Erik Glombitza, Bensheim (DE); Jens Nickel, Weinheim (DE); Sowmya Shivananda, Kumaraswamy/Bangalore (IN)

(73) Assignees: TE Connectivity India Private, Karnataka (IN); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/262,685

(22) Filed: Sep. 12, 2016

(65) Prior Publication Data

US 2017/0077619 A1 Mar. 16, 2017

(30) Foreign Application Priority Data

Sep. 10, 2015 (EP) ..... 15184752

(51) Int. Cl.
*H01R 9/24* (2006.01)
*H01R 4/18* (2006.01)
*H01R 43/16* (2006.01)

(52) U.S. Cl.
CPC ..... *H01R 4/185* (2013.01); *H01R 43/16* (2013.01)

(58) Field of Classification Search
CPC ..... H01R 4/185; H01R 43/16
USPC ..... 439/885
See application file for complete search history.

(56) References Cited

U.S. PATENT DOCUMENTS

| | | | | |
|---|---|---|---|---|
| 4,904,539 | A | 2/1990 | Kling et al. | |
| 5,957,739 | A * | 9/1999 | Bianca | H01R 43/16 439/876 |
| 6,379,161 | B1 * | 4/2002 | Ma | H01R 43/16 29/860 |
| 6,620,002 | B1 * | 9/2003 | Billman | H01R 12/52 439/885 |
| 9,011,189 | B2 * | 4/2015 | Tsukamoto | H01R 43/16 439/885 |
| 2014/0206245 | A1 | 7/2014 | Sato | |

FOREIGN PATENT DOCUMENTS

| | | |
|---|---|---|
| EP | 0125098 A1 | 5/1984 |
| WO | 9716870 A1 | 11/1996 |

OTHER PUBLICATIONS

European Search Report, dated Mar. 7, 2016, 9 pages.

* cited by examiner

*Primary Examiner* — Xuong Chung Trans
(74) *Attorney, Agent, or Firm* — Barley Snyder

(57) ABSTRACT

An electrical connector unit and having an electrical connector and a connection tab connected to the electrical connector or connecting the electrical connector to a carrier-strip when a carrier strip is included in the electrical connector unit. The connector tab has a weakened shear resistance zone, so when the connection tab is sheared to separate it from the electrical connector or to separate the electrical connector and the carrier-strip, a reduced shearing force is required to shear the connection tab.

17 Claims, 7 Drawing Sheets

SHEET METAL PART WITH IMPROVED CONNECTION TAB GEOMETRY

CROSS-REFERENCE TO RELATED APPLICATIONS

This application claims the benefit of the filing date under 35 U.S.C. § 119(a)-(d) of European Patent Application No. 15184752.2, filed on Sep. 10, 2015.

FIELD OF THE INVENTION

The present invention relates, in general, to electrical connectors and, more specifically, to an electrical connector unit that includes the electrical connector and a connection tab that is used in producing the electrical connector. The present invention also relates to a method of producing the electrical connector.

BACKGROUND

Electrical connectors of the general type disclosed and claimed in this application are well known from the prior art. In order to facilitate storage, transport, and assembly of these electrical connector, they are commonly produced such that a connection tab is adapted to connect the electrical connector with a carrier-strip. These features allow a reeling of the electrical connectors connected to the carrier-strip onto a reel, which subsequently allows easy transportation or storage of a large quantity of electrical connectors. A reel with furled electrical connectors facilitates feeding the individual electrical connectors into a production process, so that the orientation of the electrical connectors is the same for all individual electrical connectors and no precautions for proper orientation of the electrical connectors is necessary.

During the production process, the individual electrical connectors to be processed need to be removed from the carrier-strip. This is performed by cutting the connection tab with a shear. Commonly, for instance, in the case of crimped contacts, removal of the electrical connectors is performed simultaneously with at least one further production step. Cutting the connection tab and, thereby removing the electrical connector from the carrier-strip is performed using a floating shear. The shearing force exerted to the connection tab by a shear portion of the floating shear depends on the material strength (e.g., thickness) of the connection tab.

When considering material thickness and the resulting shear force necessary for cutting the connection tab, the thickness of the shear portion has to be adapted to and depends on the material thickness. An increased thickness of the shear portion, however, reduces the available space for elements to be connected to the electrical connector, which may be, for instance, a cable with insulation and exposed lead wires. Crimping the lead wires and the insulation is preferably performed simultaneously with cutting the connection tab. The reduced space for the cable may negatively affect the crimping as the cable may not be positioned properly due to the thicker shear portion. Cutting and simultaneously processing an electrical connector, therefore, becomes more difficult with increasing sheet metal thickness, which, in turn, also reduces the lifetime of the floating shear as it is exposed to higher loads.

SUMMARY

The inventive electrical connector unit solves this and other problems by a connection tab which has a weakened zone, in which the shear resistance of the connection tab is reduced compared to an unprocessed connection tab of the same construction type and size. The inventive method solves this problem by reducing the shear resistance of the connection tab in at least one weakened zone.

An electrical connector unit, constructed in accordance with the present invention comprises an electrical connector and a connection tab. The connection tab is connected to the electrical connector and has a weakened shear resistance zone that breaks and causes separation of the electrical connector and the connection tab when a shear force is applied to the weakened shear resistance zone of the connection tab. This electrical connector unit can also include a carrier-strip and when a carrier-strip is included the connection tab connects the electrical connector to the carrier-strip, so that the shearing of the connection tab causes the electrical connector and the carrier strip to separate.

In general, it is preferable if the connection tab is monolithically connected to the electrical connector, and the carrier-strip when included, which are initially stamped together. In the following, exemplary embodiments are used to describe the invention and its improvements in greater detail with reference to the figures. The various features shown in the embodiments may be used independently of each other in specific applications.

DETAILED DESCRIPTION OF THE EMBODIMENT(S)

Figure 1:
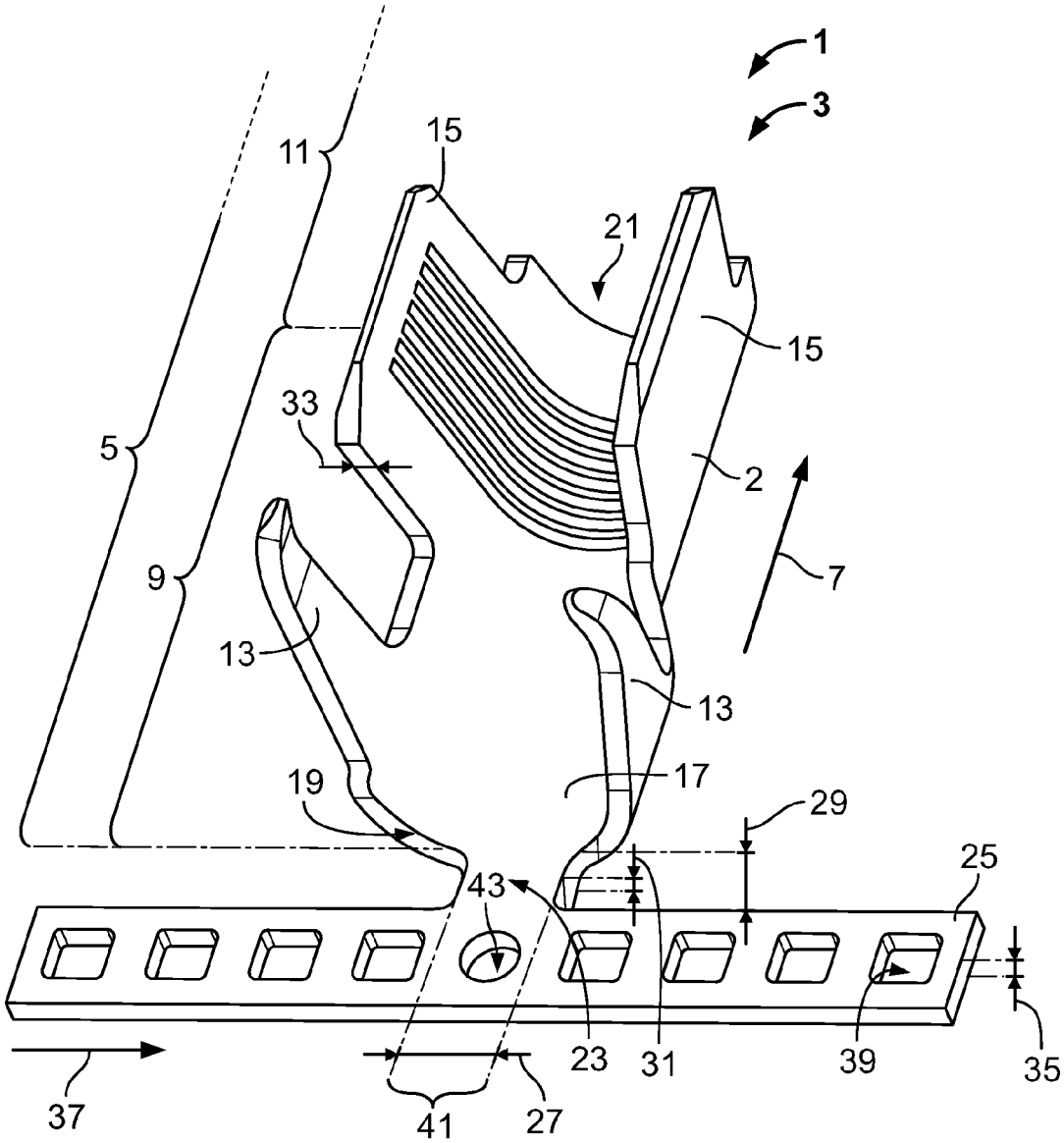
Fig. 1 Prior Art
FIG. 1 shows a prior art electrical connector unit connected to a carrier-strip.

FIG. 1 shows an electrical connector unit 1 of the prior art, which is stamped and bent from a sheet metal 2. The electrical connector unit 1 is shown in a stamped (or otherwise shaped) and bent state 3. The electrical connector unit 1 includes an electrical connector 5 which is oriented along a connector direction 7. The electrical connector 5 comprises a crimp region 9 and a connector region 11.

Figure 5:
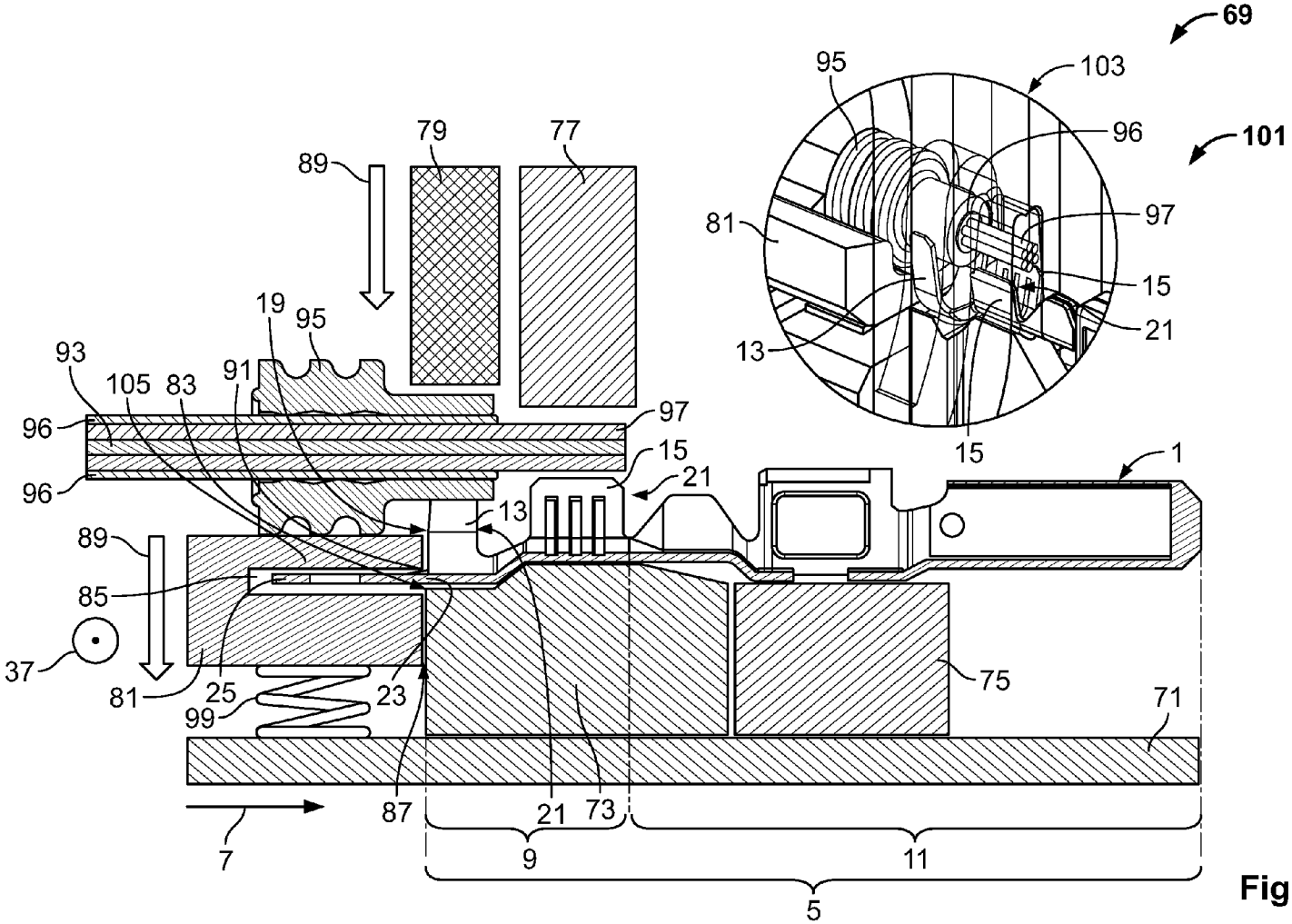
FIG. 5 shows, in a sectional view, a crimping apparatus and FIG. 5(*a*) is a perspective view of a portion of an electrical connector unit in a crimping apparatus.
Figure 6A:
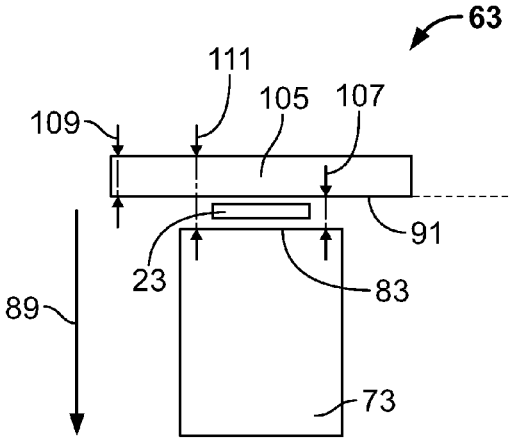
FIGS. 6(*a*) to 6(*d*) show a floating shear adapted to cut a prior art connection tab or a connection tab according to the present invention.
Figure 6B:
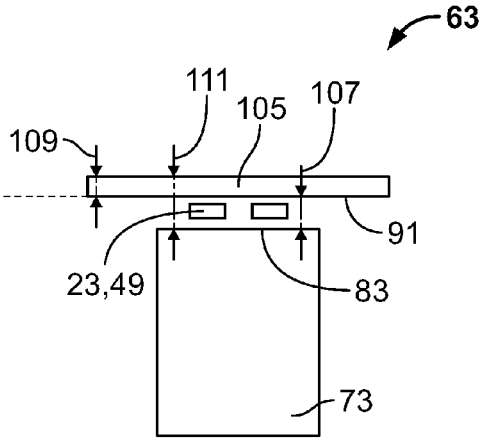
Figure 6C:
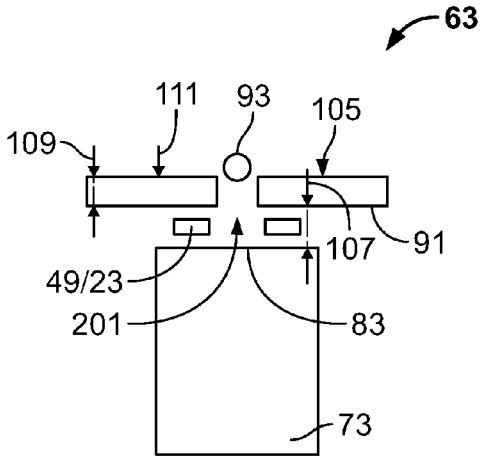
Figure 6D:
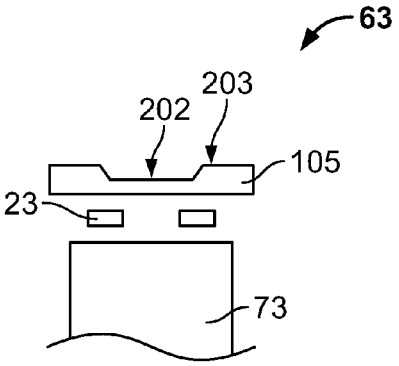

The electrical connector 5 comprises two insulation crimping arms 13 and two wire crimping arms 15. The number and/or shape of the crimping arms 13, 15 are exemplary and may take other forms. Between the crimping arms 13, 15, a crimp bottom 17 extends from the cable end 19 of the electrical connector 1 in the connector direction into the connector region 11. In the stamped and bent state 3, the crimping arms 13, 15 form a receptacle 21 adapted to receive a wire comprising a conductor and an insulation, neither of which are shown in FIG. 1, but are illustrated in FIG. 5.

The electrical connector unit 1 further comprises a connection tab 23 and a carrier-strip 25. The connector portion 5 and the carrier-strip 25 are monolithically connected to the connection tab 23 in the prior art embodiment shown in FIG. 1.

The connection tab 23 has a connection tab width 27, a connection tab depth 29, and a connection tab thickness 31. The connection tab thickness 31 is identical to the sheet metal thickness 33 and the carrier-strip thickness 35.

The carrier-strip 25 is oriented along a carrier-strip direction 37, which is essentially perpendicular to the connector direction 7 in the embodiment shown in FIG. 1. The connector direction 7 and the carrier-strip direction 37 may span any angle larger than 0° up to 90°. The carrier-strip 25 has a plurality of feeding openings 39. As an example, the feeding openings 39 can have an essentially squared shape, as shown in FIG. 1. Of course, the feeding openings 39 can have any shape. The feeding openings 39 make a feeding operation possible. This cuts down on costs. For example, the feeding openings 39 can be used to translate the carrier-strip 25 and the electrical connector 5 attached thereto along or opposite to the carrier-strip direction 37.

In a tab-region 41, the carrier-strip 25 has a detection opening 43 which is distinct from the feeding openings 39 in its shape. The detection opening 43 is circular in FIG. 1. The detection opening 43 is used to detect the tab-region 41 and to precisely position the electrical connector 5 during feeding of the carrier-strip 25 and the electrical connector 5 attached thereto. Further, the detection opening 43 (also called pilot hole) may also be taken for the feeding operation itself.

Figure 2:
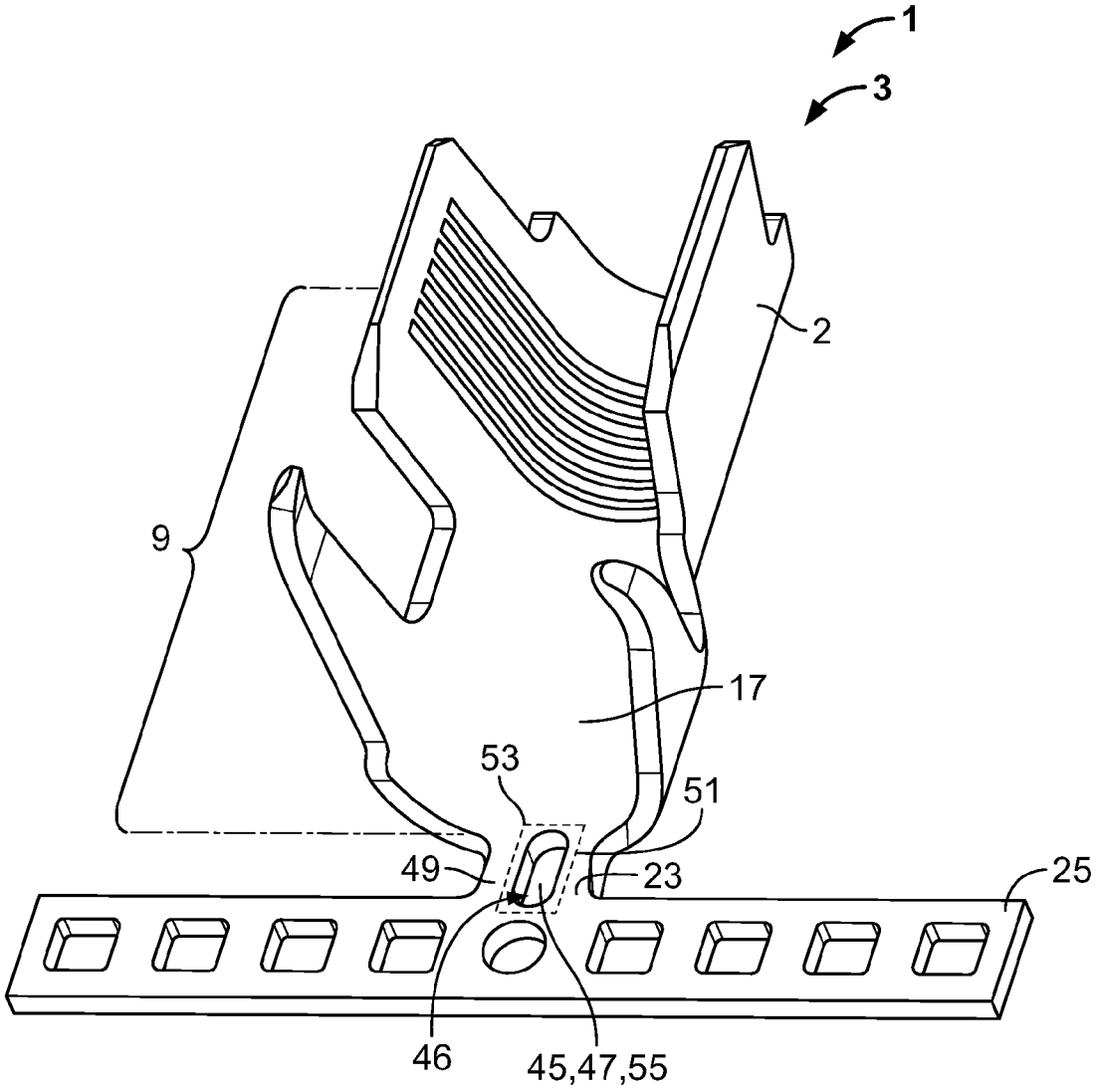
FIG. 2 shows a first embodiment of an electrical connector unit constructed in accordance with the present invention in a stamped and bent, yet uncrimped state.

An electrical connector unit 1 constructed in accordance with the present invention is shown in FIG. 2. The electrical connector unit 1 is stamped and bent from a sheet metal 2 and shown in the shaped and bent state 3 and comprises similar components as in the prior art electrical connector unit shown in FIG. 1. The connection tab 23, however, is different in that it has a weakening element 45 which is embodied as a through hole 47 shown in FIG. 2. The connection tab 23, therefore, comprises multiple connections to the electrical connector 5 and the carrier-strip 25 by a first tab portion 49 and a second tab portion 51. However, the weakening element 45 can take many other forms.

The through hole 47 defines a weakened zone 53 which is indicated by a dashed rectangle in FIG. 2. In this embodiment of the electrical connector unit 1, the through hole 47, as well as the weakened zone 53, extend into the carrier-strip 25 and the crimp bottom 17 of the crimp region 9. The through hole 47 is embodied as a slotted hole 55.

Figure 3:
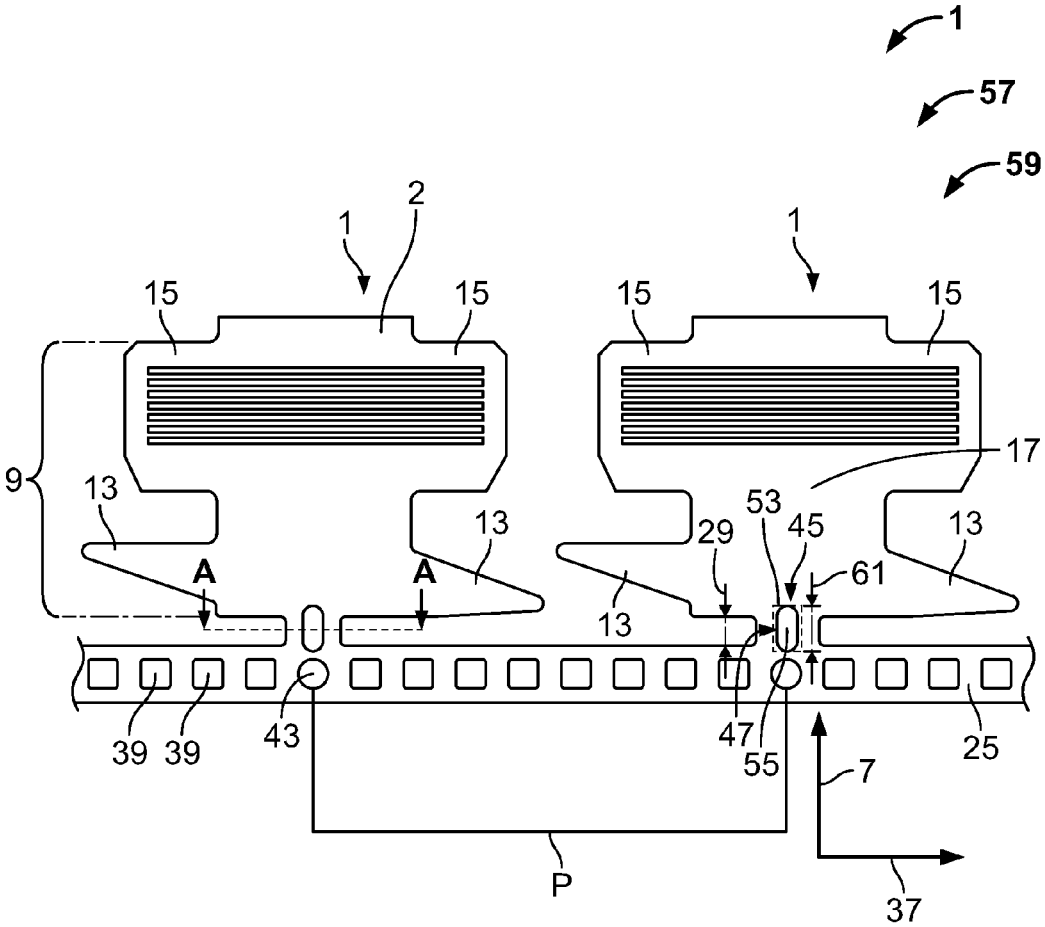
FIG. 3 shows the first embodiment of the FIG. 2 electrical connector in a stamped and flat (unbent) state.
Figure 4A:
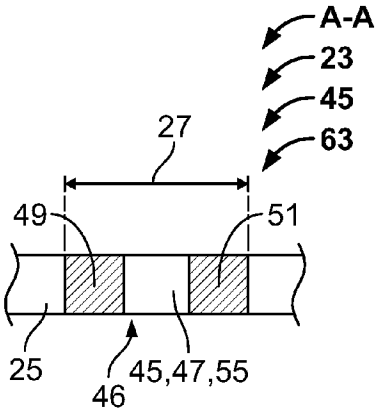
FIGS. 4(*a*) to 4(*e*) show several embodiments of connection tab cross-sections electrical connector units constructed in accordance with the present invention and FIG. 4(*f*) shows a connection tab cross-section of the FIG. 1 prior art electrical connector unit.
Figure 4B:
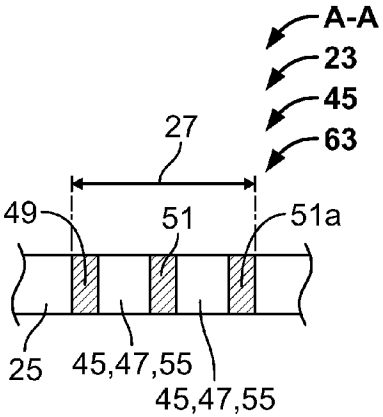
Figure 4C:
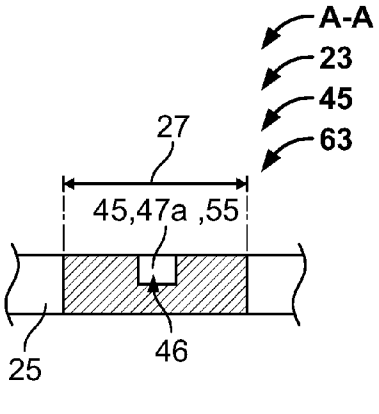
Figure 4D:
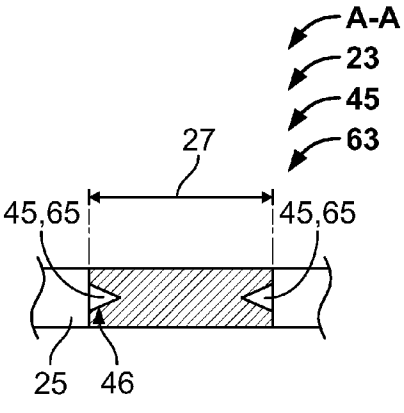
Figure 4E:
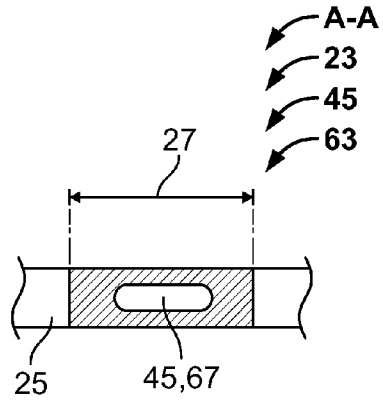
Figure 4F:
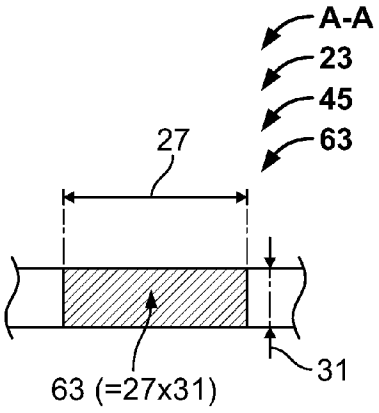

FIG. 3 shows a set 57 of electrical connectors 5 according to the first embodiment of the invention shown in FIG. 2. The set 57 is stamped from a sheet metal 2 and is in a stamped state 59 in which the crimping arms 13, 15 are not bent but lie in a plane spanned by the connector direction 7 and the carrier-strip direction 37. The set 57 comprises a selection of two electrical connectors 5. However, additional electrical connectors may be added and connected at the carrier-strip 25. This is indicated by the interruption of the carrier-strip 25 in the left and in the right side of FIG. 3.

As shown in FIG. 3, the weakened zone 53 and the slotted hole 55 extend into the carrier-strip 25 and the crimp bottom 17 of the crimp region 9. This results in a length 61 of the weakened zone 53 being larger than the connection tab depth 29.

FIG. 3 also shows a periodicity P in which the individual electrical connectors 5 are repetitively attached to the carrier-strip 25. In FIG. 3 an electrical connector 5 is attached to the carrier-strip 25 every ten openings 39, 43, hence, the periodicity P is one sheet metal part 1 per ten openings 39, 43. The periodicity P may vary according to the size and/or shape of the electrical connector 5 concerned. The openings 39 are optionally used for cost saving and could also be omitted.

In FIGS. 4(*a*) to 4(*e*), five, exemplary weakening elements 45 are shown in cross-section taken along line A-A in FIG. 3. The viewing direction is opposite to the connector direction 7. The cross-section views in FIGS. 4(*a*) to 4(*e*) represent cross-sections 63 of the connection tab 23 for different embodiments of the weakening element 45. The cross-sections 63 are indicated by a cross-hatching.

In FIG. 4(*a*), the weakening element 45 or recess 46 is a through hole 47 which may also be a slotted hole 55 representing the first embodiment of the inventive electrical connector unit 1 as, for instance, shown in FIGS. 2 and 3.

FIG. 4(*b*) shows a second embodiment of the inventive electrical connector unit 1 comprising two through holes 47. Whereas the first embodiment shown in FIG. 4(*a*) comprises the first tab portion and the second tab portion 49, 51, the second embodiment shown in FIG. 4(*b*) comprises an additional third tab portion 51*a*. The through holes 47 of FIG. 4(*b*) may be embodied as slotted holes 55 as well.

The weakening element 45 shown in FIG. 4(*c*) is embodied as a hole 47*a*, which may also be embodied as a slotted hole 55.

The direction along which a hole is oriented is preferably substantially perpendicular to the surface of the connection tab, but not limited to this orientation. If several holes are provided in the connection tab, the holes may be arranged symmetrically, that is on opposite sides of the connection tab.

A through hole may furthermore demand less strict requirements for controlling the depth of the hole (e.g, the drilling/stamping depth). A through hole is easier to produce than a hole of a predetermined depth.

In FIG. 4(*d*), the weakening element 45 is embodied as a notch 65. In this embodiment, two notches 65 are symmetrically provided in the walls of the connection tab 23. The two notches 65 are exemplary. Several notches 65 may be provided in a wall of the connection tab 23 and the notches 65 may be placed in a non-symmetric manner.

In FIG. 4(*e*), the weakening element 45 is embodied as a cavity 67, which is completely encircled by the material of the connection tab 23 and only visible in the cross-section view.

In an advantageous embodiment of the present invention, the connection tab cross-section area is reduced by at least 30% compared to the connection tab cross-section of an unprocessed connection tab of the same construction type and size. A reduction of the cross-section area by more than 30% may reduce the sheer force by the same relative amount.

The cross-section area may preferentially be reduced by at least 40%, more preferentially by at least 50%. A reduction of the connection tab cross-section area by substantially more than 50%, for instance 75%, may decrease the mechanical stability of the connection tab. The weakened zone may comprise a multitude of weakening elements forming a structure with a substantially maintained mechanical stability as compared to the unprocessed connection tab. The weakening elements may, for instance, be arranged in the connection tab such that the residual sheet metal of the connection tab forms a structure similar to a honeycomb.

The five shown embodiments of possible cross-sections 63 of the connection tab 23 are only exemplarily. The weakening element 45 may be realized by different structures or a combination of different structures.

In FIG. 5, a crimping apparatus 69 (which may also be called a crimp tool or applicator) is shown in cross-section. The crimping apparatus 69 comprises an applicator base 71, an anvil 73, a terminal support 75, a wire crimper 77, an insulation crimper 79, and a floating shear 81. The electrical connector unit 1 is positioned such that the crimp region 9 abuts the anvil 73 and the connector region 11 partially abuts the terminal support 75.

When the shearing force is reduced by at least 10%, preferably by at least 20%, more preferably by at least 30% and most preferably by at least 50%, the lifetime of the cutting shear may be increased by the same relative amount by which the shearing force is reduced.

In an advantageous embodiment of the inventive method of producing an electrical connector unit, the recess is formed according to any one or a combination of the following methods: stamping a hole or a through hole; drilling a hole or a through hole; beveling or milling a recess. It is especially preferred that the generating of the weakening element be performed simultaneously with stamping of the electrical connector unit. Therefore, stamping a hole, a through hole, or a recess as a weakening element may be regarded as most preferable method for generating the weakening element.

In another advantageous embodiment of the inventive method of producing an electrical connector, the shear resistance may be reduced by reducing the material strength of the connection tab in the at least one weakened zone. The material strength may be reduced by treating the connection tab material chemically, thermally (e.g. annealing), and/or metallurgically. The thermal treatment may be performed, for example, by induction or application of an energy beam such as for example, a laser beam or electron beam.

The connection tab may be treated with chemical substances in an etching process or a laser operation. Furthermore, the shear resistance of the connection tab material may be reduced by means of metallurgical processes which, for instance, alter the composition of the material components in order to reduce for instance the hardness of the connection tab material.

In FIG. 5, the whole electrical connector unit 1 is shown. Specifically, connector region 11 is visible and the whole electrical connector 5 is shown as well. The cable end 19 of the crimp region 9 is located at or near an anvil edge 83. The floating shear 81 is located in the proximity of the anvil edge 83. The connection tab 23 extends over the anvil edge 83 into a shear recess 85 of the floating shear 81. The shear recess 85 is embodied as a slot opening towards the anvil 73 and partially opening in and opposite the carrier-strip direction 37. The connection tab 23 is located at the anvil edge 83 and extends into the shear recess 85, while the carrier-strip 25 is, considering the connector direction 7, completely located in the shear recess 85 and is guided in the shear recess 85 along the carrier-strip direction 37.

The anvil 73 and the floating shear 81 glide along each other. Between the anvil 73 and the floating shear 81, a gap 87 may be formed. An adjustment of the crimping apparatus 69 to define the position of electrical connector unit 1 in the connector direction 7 determines how much of the connection tab 23 material is left over at the electrical connector 5 after cutting the connection tab 23.

The crimping apparatus 69 shown in FIG. 5 performs two processing steps simultaneously. Both steps are initiated by a movement of the wire crimper 77, the insulation crimper 79, and the floating shear 81, indicated by the arrows 89. The wire crimper 77, the insulation crimper 7, and the floating shear 81 are moved relative to the other elements of the crimping apparatus 69. When the wire crimper 77, the insulation crimper 79, and the floating shear 81 perform the movement according to the arrows 89, the shear edge 91 and the anvil edge 83 shear the connection tab 23 and cut off the connection tab 23 and the carrier-strip 25 from the sheet metal part 1. Within the same movement, a cable 93, which is stripped in a region between the insulation crimping arms 13 and the end of the wire crimping arms 15 facing towards the connector region 11, is moved along the direction indicated by the arrows 89 as well.

The exemplarily shown cable 93 further comprises a seal 95 and a cable insulation 96. The seal 95 is optional and can be omitted. During the movement along the arrows 89, the cable 93, the seal 95, and the conductor (or stripped wire) 97 are moved into the receptacle (or crimp barrel) 21 which is formed by the insulation crimping arms 13 and the wire crimping arms 15. When cable 93, seal 95, and conductor 97, if present, are completely inserted into the receptacle 21 (which may likewise be called "crimp barrel", "wire crimp barrel" or "conductor crimp barrel") along the direction indicated by the arrows 89, the wire crimper 77 crimps/bends the wire crimping arms 15 around the conductor 97 and simultaneously the insulation crimper 79 crimps the insulation crimping arms 13 around the seal 95 and/or cable insulation 96. The upward movement of the floating shear 81 is supported by a spring member 99.

The crimping apparatus 69, therefore, establishes a mechanical and electrical connection between the cable 93 and the electrical connector 5 by means of the insulation crimping arms 13 crimped around, respectively, attached to the seal 95 and/or insulation 96 and by the wire crimping arms 15 crimped around the conductor 97, establishing the electrical connection between the cable core (the lead wires 97) and the sheet metal part 1. After the processes of cutting and crimping are performed, the carrier-strip 25 may be moved further along the carrier-strip direction 37 feeding a further electrical connector unit 1 into the processing position 101 shown in FIG. 5.

In FIG. 5, the electrical connector 5, the connection tab 23 and the carrier-strip 25 are generally similar to the prior art. The differences in processing, respectively, in the crimping apparatus 69 of the inventive embodiments of the electrical connector 5 and the connection tab 23 will be explained in FIG. 6.

In circle 103 in FIG. 5(*a*), a perspective view of the conductor 97, the seal 95, the cable insulation 96, and the receptacle 21 is shown to illustrate that the insulation member 95 is inserted in between the insulation crimping arms 13 and the conductor 97 in between the wire crimping arms 15.

In FIG. 6, the difference between the prior art connection tab 23 and the inventive connection tab 23 is illustrated. The figure schematically shows the anvil 73, the upper shear arm 105, and the corresponding connection tab cross-section 63. The upper shear arm 105 (see FIG. 5) comprises the shear edge 91 and the anvil 73 comprises the anvil edge 83, with the connection tab 23 being sheared by these two edges 83, 91 during the movement of the upper shear arm 105 along the direction 89.

From FIG. 6, it becomes clear that the shear edge 91, adapted for cutting a prior art connection tab 23 (FIG. 6(*a*)), is located at the same height 107 (measured relative to the anvil edge 83) as the shear edge 91 adapted for cutting an inventive connection tab 23 (FIG. 6(*b*)). However, as the prior art connection tab 23 has a higher shear resistance than the inventive connection tab 23, the thickness 109 of the upper shear arm 105 is adapted according to the shear resistance. In consequence, a positioning height 111 of the upper shear arm 105 is larger for the prior art connection tab 23 than for the inventive connection tab 23. The positioning height 111 determines how far the seal 95 (if present), the cable insulation 96, and the lead wires 97 may initially be inserted into the receptacle or crimp barrel 21 in the processing position 101 (see FIG. 5). A smaller thickness 109 of the upper shear arm 105, therefore, results in a smaller positioning height 111 resulting in a deeper insertion of the seal 95, the insulation 96, and the conductor 97 into the receptacle 21, which represents an optimized positioning of the conductor 97 between the wire crimping arms 15 and of the seal 95 (if present) and/or the insulation 96 between the insulation crimping arms 13.

In an alternative embodiment shown in FIG. 6(*c*), a slot 201 may be provided in the upper shear arm 105. Slot 201 may provide space for a cable 93 that can be placed in the slot 201 during crimping, welding, etc. . . . .

In a further alternative, shown in FIG. 6(*d*), the upper shear arm 105 may be provided with a depression 202 arranged in the area of the upper shear arm 105 overlaying the connection tab 23. The depression 202 is designed in the upper face 106 of the upper shear arm 105 that is placed opposite the connection tab 23.

Figure 7:
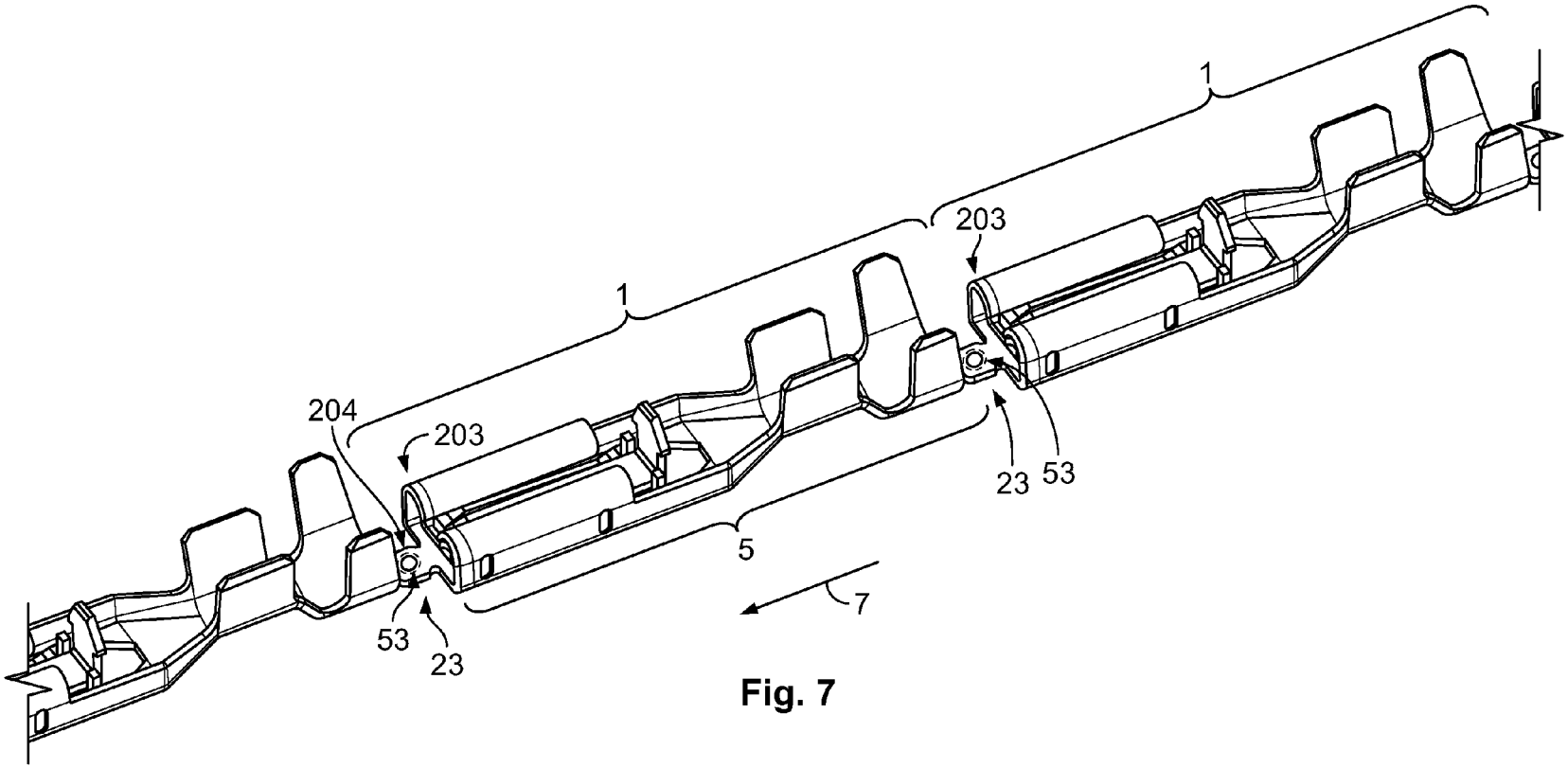
FIG. 7 shows, in a perspective view, a further embodiment of an electrical connector constructed in accordance with the present invention.

In FIG. 7, an alternative embodiment of an inventive electrical connector unit 1 is shown. In this embodiment, the electrical connector unit 1 is shown in a shaped and bent state 3. In contrast to the embodiments shown in FIGS. 2 and 3, in the embodiment shown in FIG. 7, the electrical connector unit 1 with an electrical connector 5 and its connection tab 23 are arranged as end-feed terminals without a carrier strip. The electrical connector units 1 are connected in series in the connector direction 7 with the end 203 of the electrical connector 5 opposite the connection tab 23 being connected to the connection tab 23 of the subsequent electrical connector unit 1 in the series.

Further, in the embodiment of FIG. 7, the connection tab 23 is provided with a weakened zone 53, in which the shear resistance of the connection tab 23 is reduced compared to an unprocessed connection tab 23. In the shown embodiment, the shear resistance is reduced by reducing the material strength of the connection tab 23 in the at least one weakened zone 53.

In FIG. 7, the reduction of material strength in the connection tab 23 is achieved, for example, by treating the connector tab thermally using a laser beam 204. Of course, instead of a laser beam 204, which is exemplary only, another type of energy beam, or other thermal treatment such as, for example, induction, or another kind of chemical or metallurgical treatment resulting in a reduced material strength of the connection tab 23 in the at least one weakened zone 53 may be likewise applied.

What is claimed is:

1. An electrical connector unit comprising:

an electrical connector; and a connection tab:

(a) connected to the electrical connector, and (b) having a weakened shear resistance zone that breaks and causes separation of the electrical connector and the connection tab when a shear force is applied to the weakened shear resistance zone of the connection tab, the weakened shear resistance zone having a recess extending into the electrical connector.

2. An electrical connector unit according to claim 1, wherein the recess in the weakened shear resistance zone of the connection tab is a hole.

3. An electrical connector unit according to claim 2, wherein the hole in the weakened shear resistance zone of the connection tab is a through hole.

4. An electrical connector unit according to claim 1, wherein the recess in the weakened shear resistance zone of the connection tab is a notch.

5. An electrical connector unit according to claim 1, wherein the recess is a cavity disposed within the connection tab.

6. An electrical connector unit according to claim 1, wherein the recess extends into an upper side of the connection tab.

7. An electrical connector unit comprising:

an electrical connector;

a carrier-strip; and a connection tab:

(a) connecting the electrical connector and the carrier-strip, and (b) having a weakened shear resistance zone that breaks and causes separation of the electrical connector and the carrier-strip when a shear force is applied to the weakened shear resistance zone of the connection tab, the weakened shear resistance zone having a recess extending into the electrical connector and the carrier-strip.

8. An electrical connector unit according to claim 7, wherein the recess in the weakened shear resistance zone of the connection tab is a hole.

9. An electrical connector unit according to claim 8, wherein the hole in the weakened shear resistance zone of the connection tab is a through hole.

10. An electrical connector unit according to claim 7, wherein the recess in the weakened shear resistance zone of the connection tab is a notch.

11. An electrical connector unit comprising:

an electrical connector oriented along a connector direction, and a connection tab:

(a) connected to the electrical connector and, (b) having:

(1) a cross-section area oriented essentially perpendicular to the connector direction, and (2) a weakened zone in which the shear resistance of the connection tab is reduced compared to an unprocessed connection tab of the same construction type and size not having the weakened zone, the weakened zone having a recess extending into the electrical connector.

12. An electrical connector unit according to claim 11, wherein the cross-section area of the connection tab is reduced by at least 30% compared to a cross-section area of the unprocessed connection tab.

13. An electrical connector unit comprising:

an electrical connector oriented along a connector direction;

a carrier strip; and a connection tab:

(a) connecting the electrical connector and the carrier-strip, and (b) having:

(1) cross-section area oriented essentially perpendicular to the connector direction, and (2) a weakened zone in which the shear resistance of the connection tab is reduced compared to an unprocessed connection tab of the same construction type and size not having the weakened zone, the weakened zone having a recess extending into the electrical connector.

14. An electrical connector unit according to claim 13, wherein the cross-section area of the connection tab is reduced by at least 30% compared to a cross-section area of the unprocessed connection tab.

15. A method of producing an electrical connector including the steps of:

providing an electrical connector unit having:

(a) an electrical connector, and (b) a connection tab:

(1) connected to the electrical connector, and (2) having a weakened shear resistance zone that breaks and causes separation of the electrical connector and the connection tab when a shear force is applied to the weakened shear resistance zone of the connection tab, the weakened shear resistance zone having a recess extending into the electrical connector; and shearing the electrical connector unit at the weakened shear resistance zone of the connection tab to separate the electrical connector and the connection tab.

16. A method of producing an electrical connector including the steps of:

providing an electrical connector unit having:

(a) an electrical connector, (b) a carrier-strip, and (c) a connection tab:

(1) connecting the electrical connector and the carrier-strip, and (2) having a weakened shear resistance zone that breaks and causes separation of the electrical connector and the carrier-strip when a shear force is applied to the weakened shear resistance zone of the connection tab, the weakened shear resistance zone having a recess extending into the electrical connector; and shearing the electrical connector unit at the weakened shear resistance zone of the connection tab to separate the electrical connector and the carrier-strip.

17. A method of producing an electrical connector including the steps of:

providing an electrical connector unit having:

(a) an electrical connector, and (b) a connection tab connected to the electrical connector, and reducing the material strength of the connection tab in a selected zone of the connection tab by forming a recess in the connection tab extending into the electrical connector;

shearing the electrical connector unit at the weakened shear resistance zone of the connection tab having the reduced material strength.

* * * * *